US008662840B2

(12) United States Patent
Coté

(10) Patent No.: US 8,662,840 B2
(45) Date of Patent: Mar. 4, 2014

(54) AXIAL COOLING FAN SHROUD

(75) Inventor: F. Raymond Coté, Dover, MA (US)

(73) Assignee: Robert Bosch GmbH, Stuttgart (DE)

( * ) Notice: Subject to any disclaimer, the term of this patent is extended or adjusted under 35 U.S.C. 154(b) by 492 days.

(21) Appl. No.: 13/042,810

(22) Filed: Mar. 8, 2011

(65) Prior Publication Data

US 2011/0217164 A1 Sep. 8, 2011

Related U.S. Application Data

(60) Provisional application No. 61/311,492, filed on Mar. 8, 2010.

(51) Int. Cl.
*F01D 25/24* (2006.01)

(52) U.S. Cl.
USPC ..... 415/220

(58) Field of Classification Search
USPC ..... 415/220, 227; 416/189, 169 A, 192
See application file for complete search history.

(56) References Cited

U.S. PATENT DOCUMENTS 5,106,270 A 4/1992 Goettel et al.
5,649,587 A 7/1997 Plant
6,579,063 B2 * 6/2003 Stairs et al. ..... 416/169 A
6,676,371 B1 * 1/2004 Brown ..... 415/173.1
7,309,207 B2 * 12/2007 Horski et al. ..... 415/119
2005/0180848 A1 * 8/2005 Brown ..... 415/220
2009/0211287 A1 * 8/2009 Steele et al. ..... 62/259.1

OTHER PUBLICATIONS

International Search Report and Written Opinion, PCT Application No. PCT/US2011/027508, dated May 6, 2011.

* cited by examiner

*Primary Examiner* — Nathaniel Wiehe
*Assistant Examiner* — Michael Sehn
(74) *Attorney, Agent, or Firm* — Michael Best & Friedrich LLP

(57) ABSTRACT

A fan shroud for a cooling fan assembly with a fan that is rotatable about an axis of rotation defines a downstream direction along the axis of rotation. The shroud includes a barrel for containing the fan. The barrel is concentric with the axis of rotation and further includes a base portion. A plenum includes a plenum body extending radially from the base portion. The plenum body defines at least one edge of length L1. A skirt extends proximate the at least one edge of length L1 and substantially parallel to the axis of rotation. An interface joins the at least one edge of length L1 and the skirt and has a length L1. The interface comprises an underside having a transition surface of a length less than length L1.

21 Claims, 14 Drawing Sheets

AXIAL COOLING FAN SHROUD

RELATED APPLICATIONS

The present application claims priority under 35 U.S.C. §119 to Provisional Patent Application No. 61/311,492 filed Mar. 8, 2010, the disclosure of which is hereby incorporated by reference.

BACKGROUND

The present invention relates to cooling fan shrouds and more particularly to cooling fan shrouds for use in axial-flow fan assemblies to cool engines.

A typical cooling fan assembly for drawing air through one or more heat exchangers includes a fan, a motor for driving the fan, and a shroud. The shroud serves at least three purposes: a) supporting the motor and fan, b) attaching the assembly to the heat exchanger, and c) guiding the cooling air from the downstream face of the heat exchanger into the fan.

SUMMARY

Fan efficiency and fan noise production are greatly influenced by the quality of the airflow into the fan. Two factors affecting this quality are flow uniformity and flow orientation. A more uniform flow pattern is desirable because typical cooling fans for this type of application are designed for a single inflow condition. Any non-uniformities in flow differing from this condition result in fan operation away from the design point and consequent operational inefficiency. Inflow non-uniformities also result in unsteady blade loading, which creates noise. Axial flow into the fan is equally desirable in order to more closely correspond with typical fan design methods, which assume such a condition. Flow streams other than axial therefore represent further losses in efficiency. A fan shroud configured for optimal air guidance for improved fan efficiency and reduced noise should therefore promote uniform and axial flow from the downstream face of the heat exchanger into the fan.

The present invention provides for an improved airflow structure enabling a more uniform and axial flow stream from the heat exchanger into the fan inlet, therefore allowing for more efficient fan operation while minimizing fan noise.

In one embodiment of a fan shroud for a cooling fan assembly having a fan that is rotatable about an axis of rotation and that defines a downstream direction along the axis of rotation, the fan shroud includes a barrel for containing the fan. The barrel is concentric with the axis of rotation and further includes a base portion. A plenum includes a plenum body extending radially from the base portion. The plenum body defines at least one edge of length L1. A skirt extends proximate the at least one edge of length L1 and substantially parallel to the axis of rotation. An interface joins the at least one edge of length L1 and the skirt and has a length L1. The interface comprises an underside having a transition surface of a length less than length L1.

In another embodiment of a cooling fan assembly for facilitating the transfer of heat through a heat exchanger, the cooling fan assembly includes a fan rotatable about an axis of rotation and defining a downstream direction along the axis of rotation. The fan is positioned downstream of the heat exchanger and further includes a plurality of fan blades. A fan shroud includes a barrel concentric with the axis of rotation and encircling the plurality of fan blades. The barrel defines a barrel radius and has a base portion. A plenum includes a plenum body and at least one skirt. The plenum body is coupled to the barrel and has a substantially rectangular platform viewed in the upstream direction. The plenum body defines an effective surface monotonically increasing in upstream distance from the base portion. The at least one skirt extends substantially parallel to the axis of rotation and is coupled to the plenum body. The at least one skirt includes a substantially rectilinear upstream border having a first end and a second end. The plenum defines for the at least one skirt a cross section C through the axis of rotation and normal to the skirt, a distance D1 between cross section C and the first end of the upstream border, a distance D2 between cross section C and the second end of the upstream border, and a distance D3, wherein D3 is equal to the lesser of D1 and D2, or is equal to D1 if D1 equals D2. The plenum also defines a plane P1 parallel to and offset from cross section C an offset distance DP1 less than D3. The plenum also defines a plane P2 parallel to and offset from cross section C on the opposite side of cross section C from plane P1 an offset distance DP2 less than D3. The plenum also defines a plane P3 perpendicular to both cross section C and the axis of rotation and containing a point on the upstream border, a plane P4 perpendicular to plane P3 and cross section C and containing a point located on cross section C and on the plenum body, a plane P5 parallel to and offset from cross section C an offset distance equal to D3, and a plane P6 parallel to and offset from cross section C on the opposite side of cross section C from plane P5 an offset distance equal to D3. A volume V1 is defined as enclosed by planes P1, P2, P3, P4 and the effective surface. A volume V2 is defined as enclosed by planes P1, P3, P4, P5 and the effective surface. A volume V3 is defined as enclosed by planes P2, P3, P4, P6 and the effective surface. An average cross sectional area A1 is defined as V1/(DP1+DP2). An average cross sectional area A2 is defined as (V2+V3)/((D3−DP1)+(D3−DP2). A1 is less than A2.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Typically, cooling fan shrouds include a plenum having one or more edges for contact with the surface of a heat exchanger, and a downstream circular barrel joined to the plenum that houses a cooling fan for drawing air through the shroud. More specifically, cooling fan shrouds may be conventionally characterized as having either a constant cone angle configuration or a constant wall height configuration.

Figure 1:
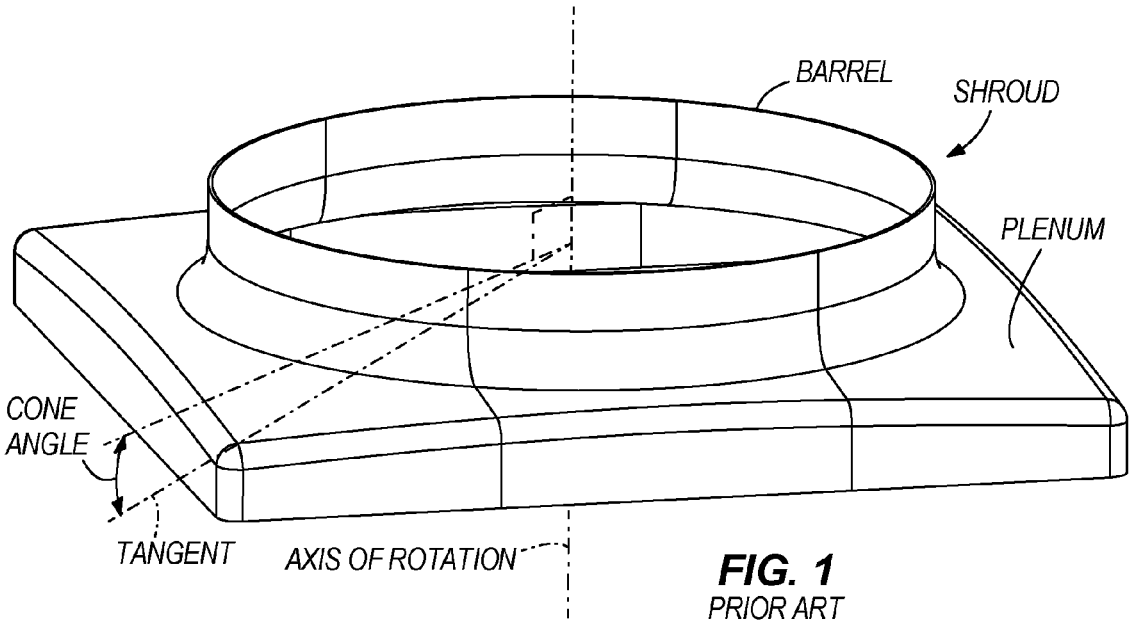
FIG. 1 PRIOR ART
FIG. 1 is a downstream perspective view of one type of conventional fan shroud.
Figure 2:
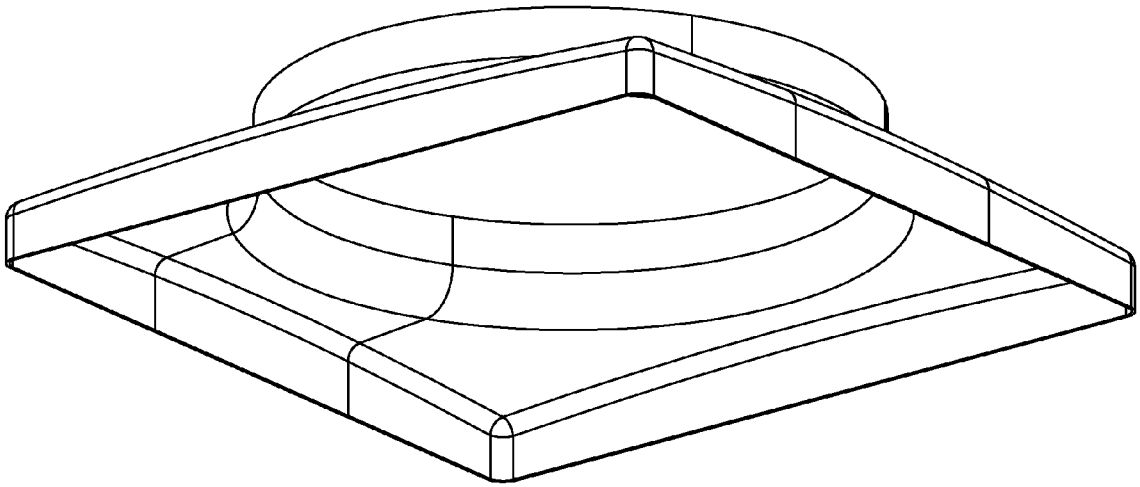
FIG. 2 PRIOR ART
FIG. 2 is an upstream perspective view of the fan shroud of FIG. 1.

Referring to FIG. 1, a shroud with a conventional constant cone angle design includes a plenum with a top surface extending from the barrel with a somewhat conical configuration, which is generally defined by a cone angle formed between a line tangent to the top surface and a line perpendicular to the axis of rotation. This cone angle is substantially constant in the azimuthal direction. A constant cone angle design has an advantage in that an overall high-volume plenum can be created through use of a small cone angle. A higher plenum volume improves the ability of the fan to draw air through the heat exchanger. The underside of a conventional constant cone angle design is shown in FIG. 2.

Figure 3:
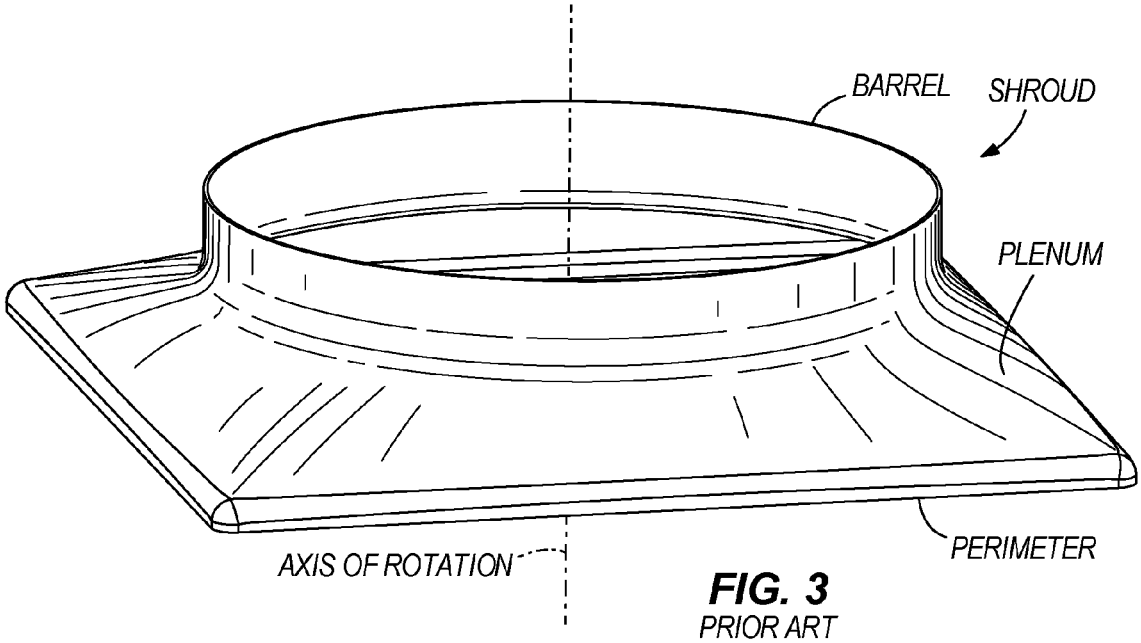
FIG. 3 PRIOR ART
FIG. 3 is a downstream perspective view of a second type of conventional fan shroud.
Figure 4:
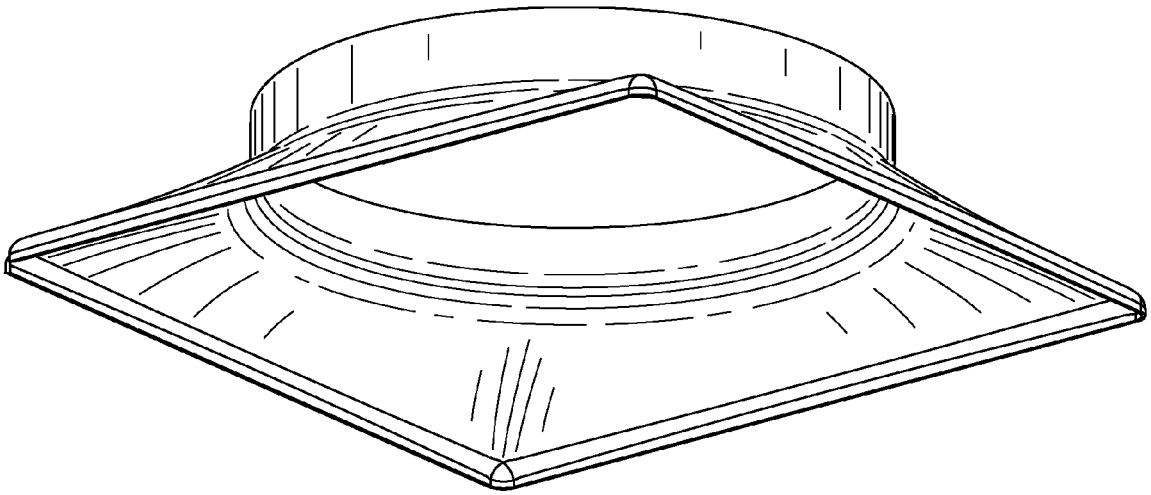
FIG. 4 PRIOR ART
FIG. 4 is an upstream perspective view of the fan shroud of FIG. 3.

Referring to FIG. 3, a shroud with a conventional constant wall height design includes a plenum with a top surface configured such that in regions where the barrel is close to the shroud perimeter, the plenum surface adjacent to the barrel is more steeply angled than the surrounding surface, creating a more axial and uniform flow into the fan. An underside of the conventional constant wall height design is shown in FIG. 4. An improvement may be made to either configuration or to any fan shroud generally to enhance the air flow into the fan, as hereinafter described.

Figure 5:
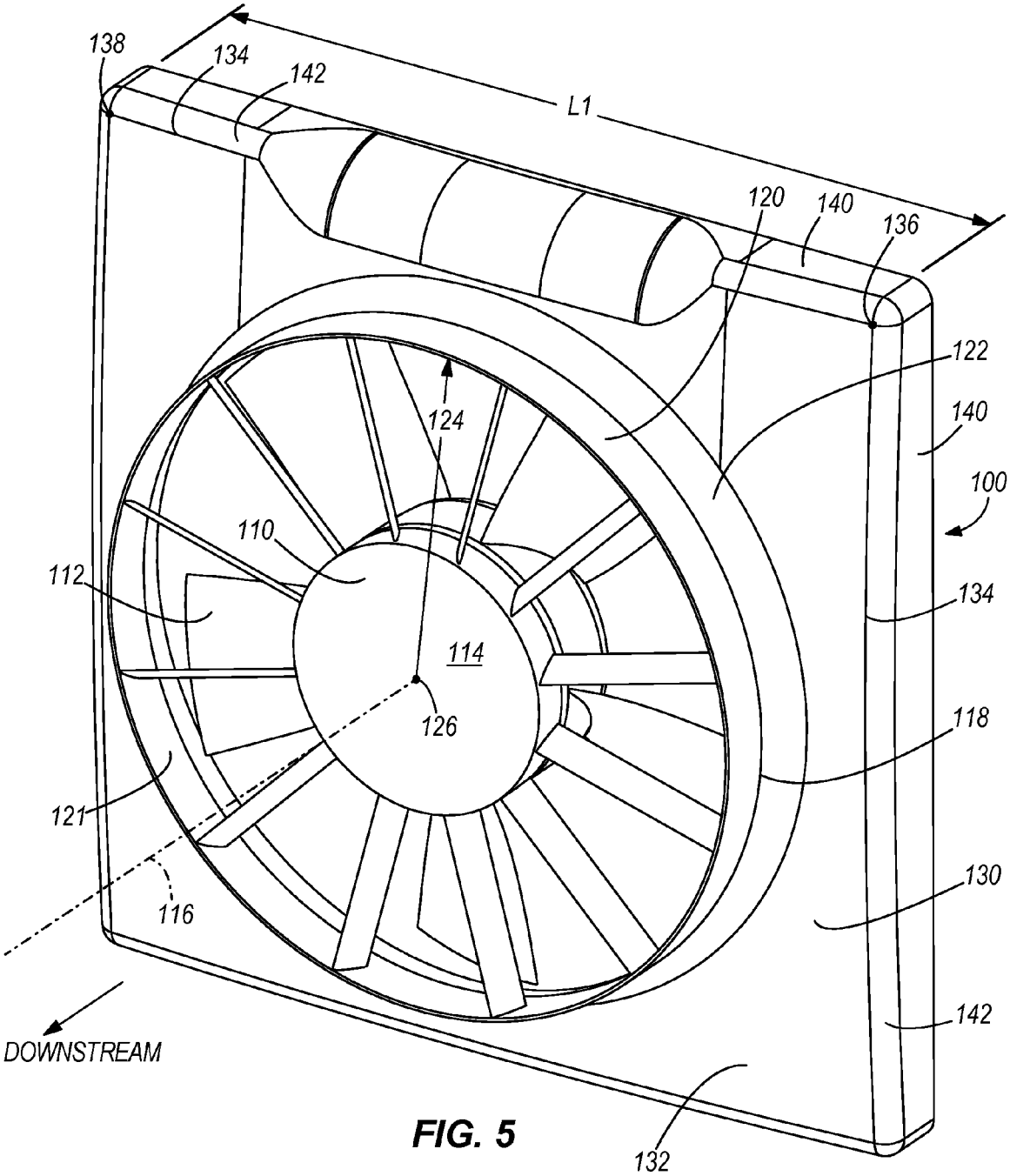
FIG. 5 is a downstream perspective view of a fan assembly embodying the present invention.

FIG. 5 illustrates an axial cooling fan assembly including a fan shroud 100 surrounding an axial fan 110. The fan 110 has one or more fan blades 112 coupled to a hub 114 rotating about an axis of rotation 116 for drawing air through a heat exchanger (not shown). A downstream direction along the axis of rotation 116 is defined such that the fan 110 is located downstream of the heat exchanger. The fan shroud is preferably constructed of plastic, preferably as an injection molded plastic part.

Figure 7:
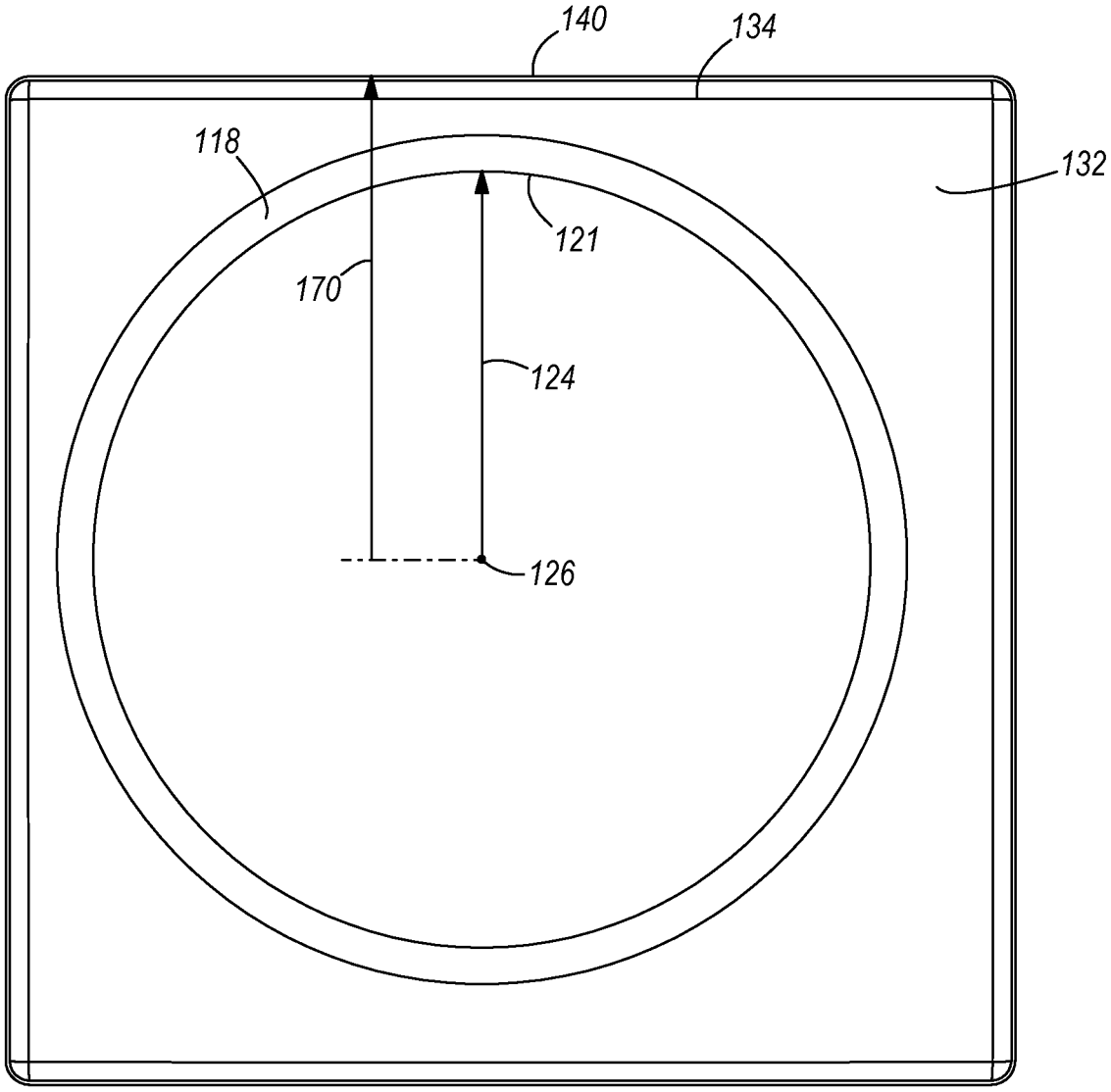
FIG. 7 is an upstream plan view of a plenum of a fan shroud showing an alternative barrel position.
Figure 8:
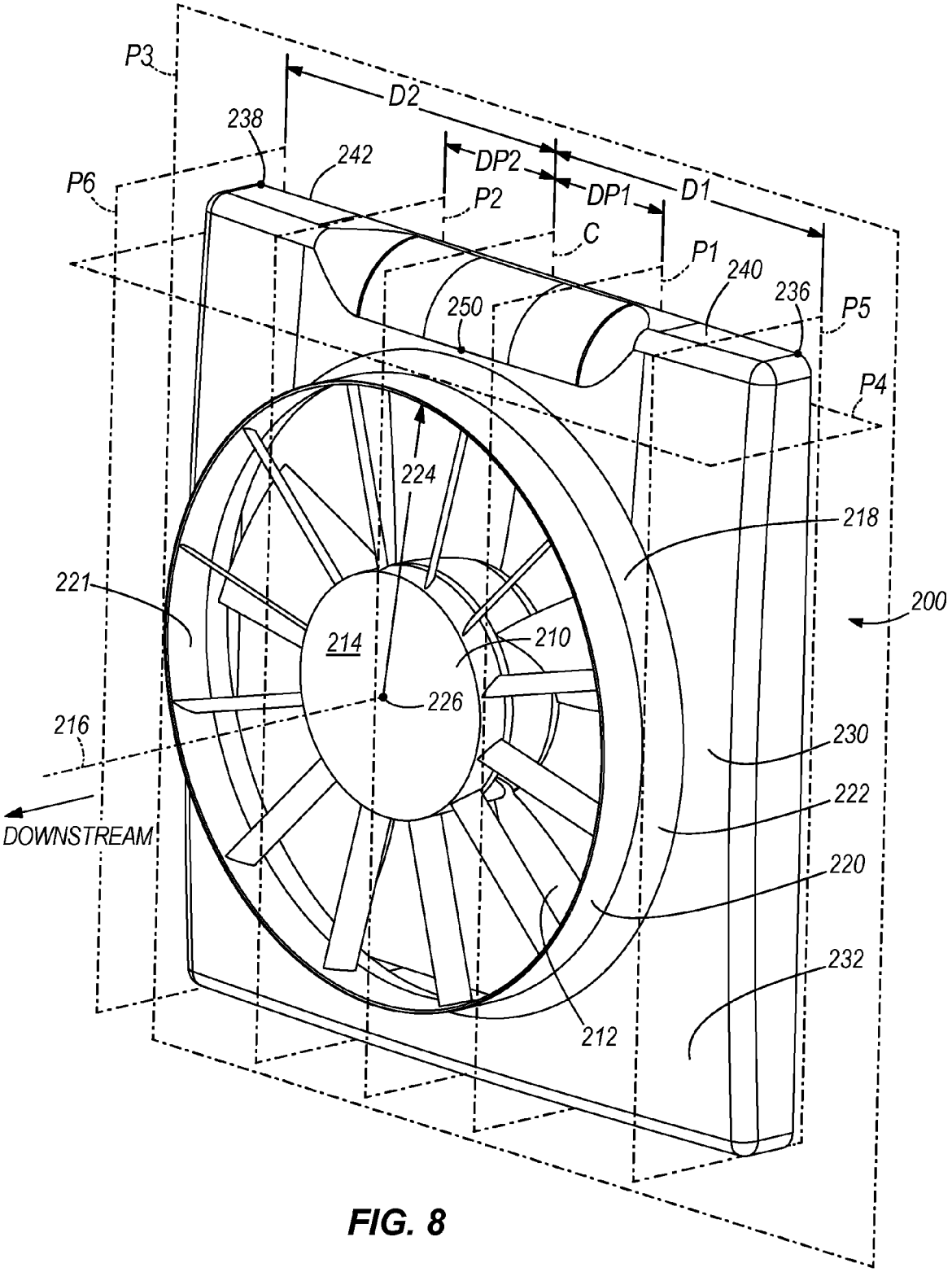
FIG. 8 is a downstream perspective view of the fan assembly of FIG. 5 shown with reference planes and dimensions added for descriptive purposes.

The fan shroud 100 includes a barrel 118 and a plenum 130. The barrel 118 generally encircles and contains the axial fan 110 and is concentric with the axis of rotation 116. The barrel 118 includes a housing portion 120 downstream of a base portion 122 that is coupled to the plenum 130. The housing portion 120 includes an inner surface 121. Referring to FIGS. 5 and 7, the barrel also defines a barrel radius 124 extending from a barrel midpoint 126 coincident with the axis of rotation, to inner surface 121 of the housing portion 120.

The plenum 130 includes a plenum body 132 radially extending from the base portion 122. The plenum body 132 defines one or more edges 134, each edge 134 including a first end 136 and a second end 138. The edges 134 generally have a length L1, shown in FIG. 5, coinciding with the distance between the first end 136 and the second end 138. The plenum body 132 extends generally perpendicular to the axis of rotation 116. Alternatively, the plenum body 132 can be angled from the base portion 122 such that the edge 134 is positioned further upstream than base portion 122. If so angled, it is not necessary that the plenum body 132 be angled from the base portion 122 at a substantially constant angle. A skirt 140 extends proximate an edge 134 and in a substantially parallel direction to the axis of rotation 116.

Figure 6:
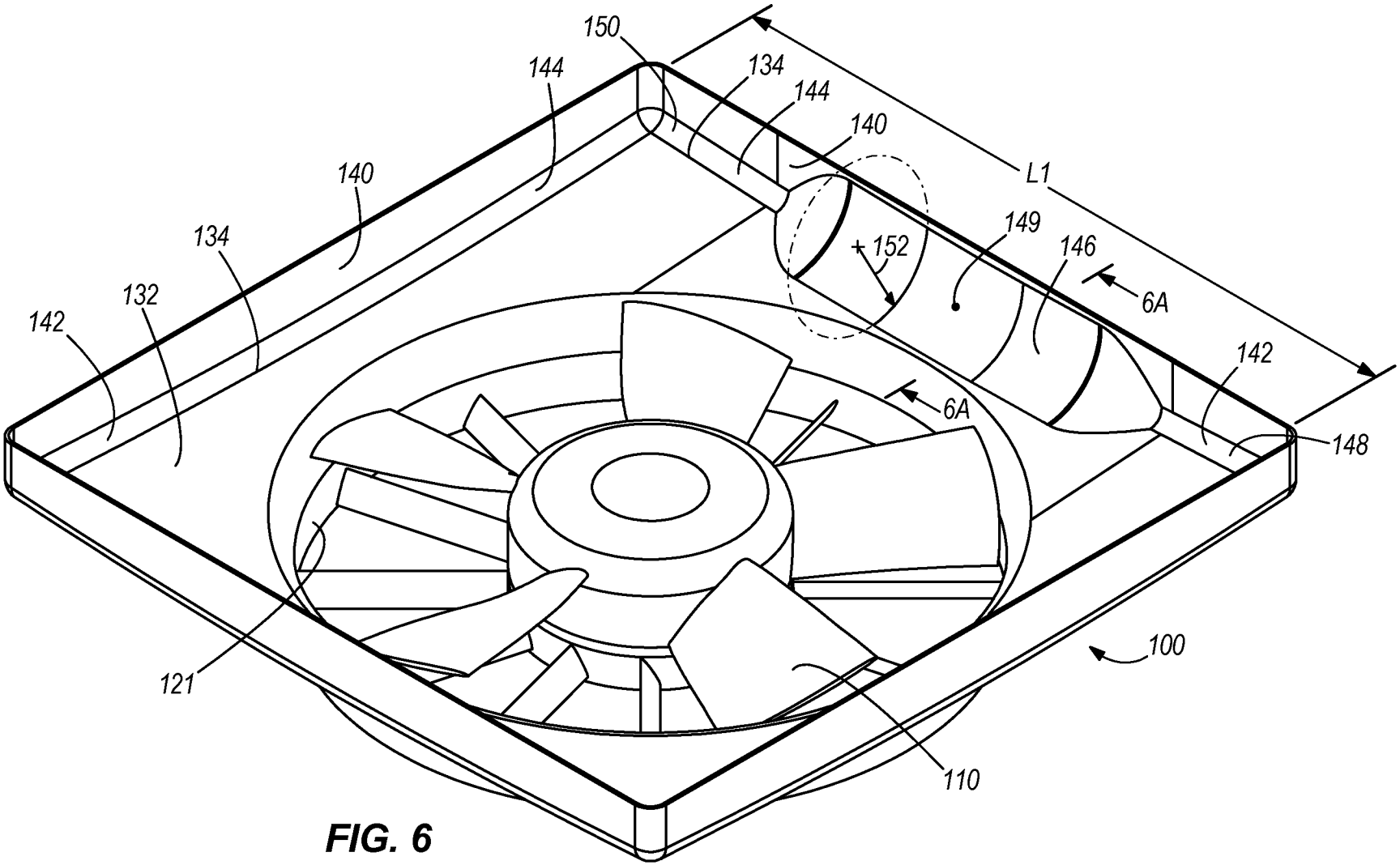
FIG. 6 is an upstream perspective view of the fan assembly of FIG. 5.

The plenum 130 also includes an interface 142 joining a respective edge 134 with a respective skirt 140. The interface 142 will preferably be of length L1 in correspondence with an adjacent edge 134. Referring to FIG. 6, the interface 142 includes an underside 144. More specifically, the underside 144 includes a transition surface 146. The transition surface 146 is distinguished from a first segment 148 of the underside 144, located on one side of the transition surface 146, and a second segment 150 of the underside 144, located on the other side of the transition surface 146. As shown, the first segment 148 and the second segment 150 provide a generally smooth surface between the skirt 140 and the edge 134. The transition surface 146 has a length less than length L1 of the interface 142 and preferably has a length between about 0.25 and about 1.5 of the barrel radius 124. The transition surface 146 can be positioned anywhere within the interface 142 but a center 149 of the transition surface 146 is preferably located at the midpoint of interface 142, or, alternatively, substantially aligned with barrel midpoint 126. In the embodiment shown in FIGS. 6, 6A, and 6B, the transition surface 146 is in the form of a concavity 146*a* and can be any of several radii. More specifically, a radius 152 of the concavity 146*a* is greater than a corresponding radius of both the first segment 148 and the second segment 150.

Figure 6A:
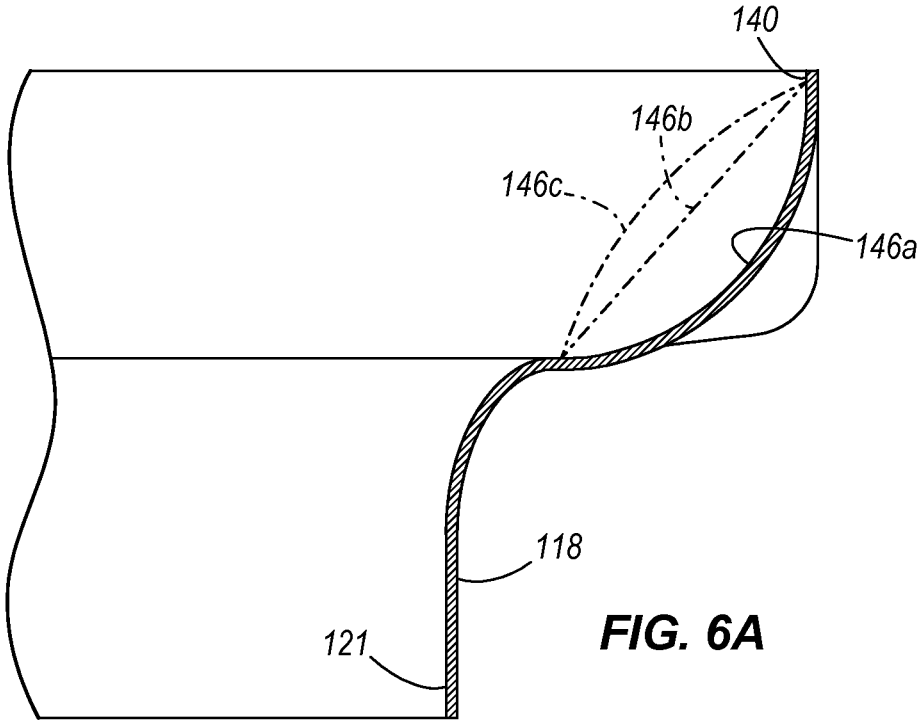
FIG. 6A is a partial section view taken along line 6A-6A of FIG. 6.
Figure 6B:
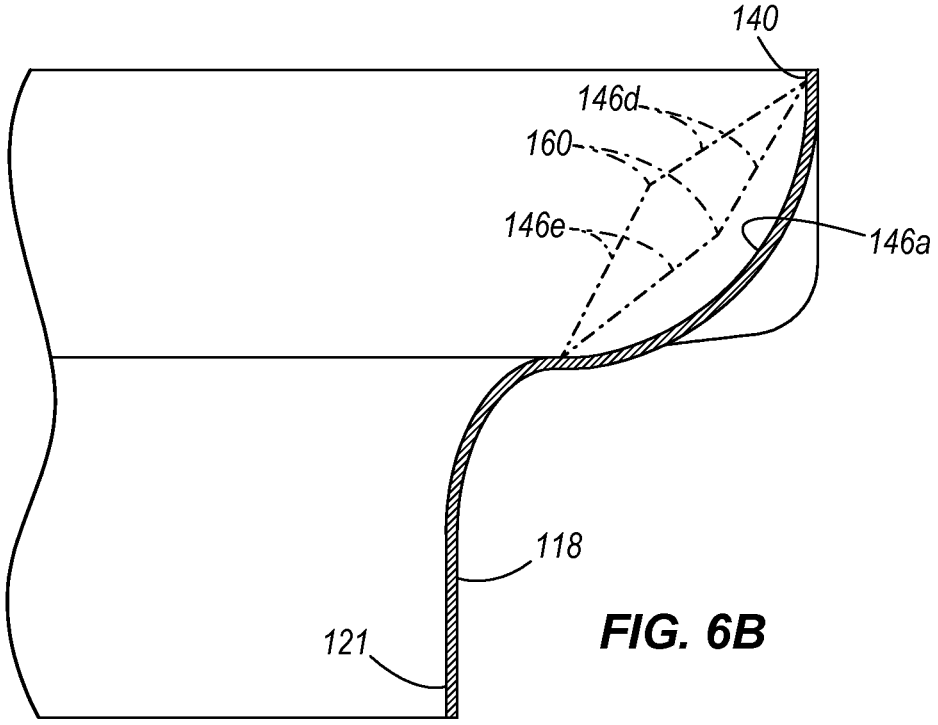
FIG. 6B is a partial section view taken along line 6A-6A of FIG. 6.

Other embodiments of the transition surface 146 are contemplated. For example, as shown in FIG. 6A, the transition surface 146 can be in the form of a linearity 146*b* or a convexity 146*c* (shown in phantom). In still other embodiments, as shown in FIG. 6B, the transition surface 146 can be in the form of a first linear surface 146*d* forming a vertex 160 with a second linear surface 146*e* (shown in phantom). The vertex 160 can be positioned toward or away from the axis of rotation 116 (see FIG. 5). In still other embodiments, the transition surface 146 can also be in the form of a plurality of steps (not shown). In the illustrated embodiments, plenum 130, which includes the plenum body 132, the skirt 140, and the interface 142 with a transition surface 146, has a substantially uniform thickness regardless of the specific manufacturing method. Such an interface 142, including the transition surface 146, allows for smoother flow of incoming air moving adjacent to skirt 140 and into axial fan 110, increasing fan efficiency and reducing fan noise as previously discussed.

Figure 9A:
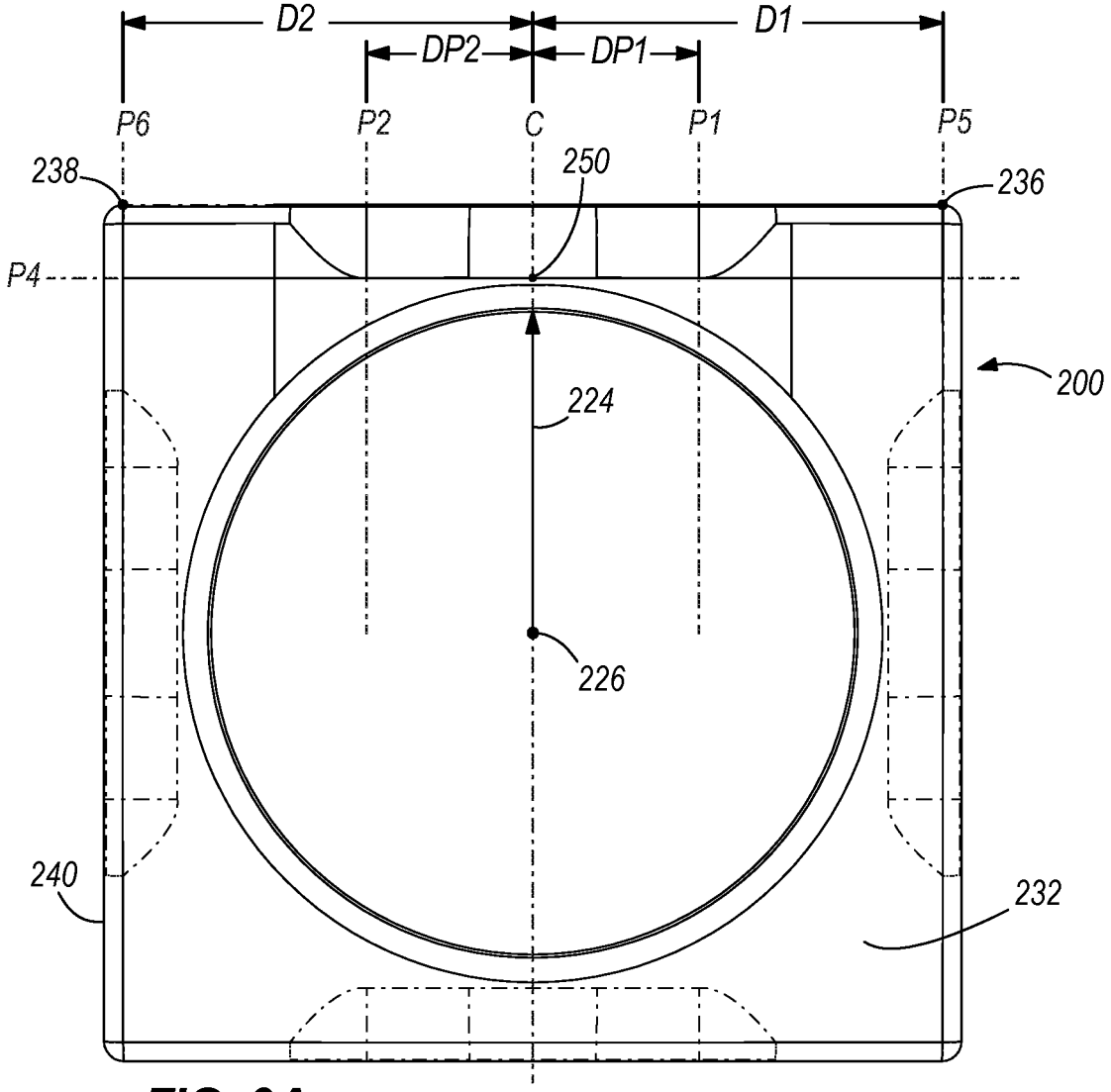
FIG. 9A is a downstream plan view of the fan shroud of FIG. 8.
Figure 9B:
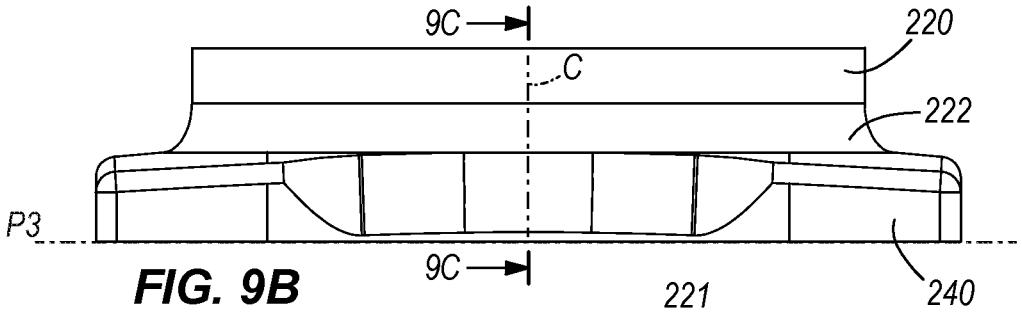
FIG. 9B is a side view of the fan shroud of FIG. 8.
Figure 9C:
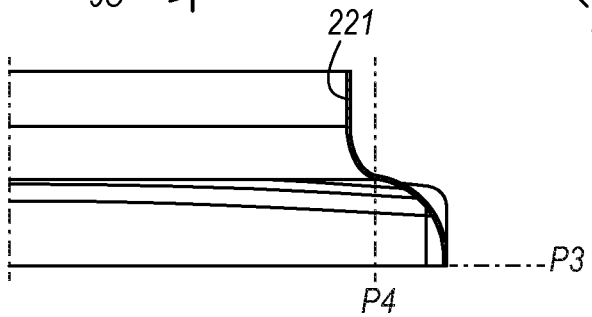
FIG. 9C is a partial section view taken along line 9C-9C of FIG. 9B.

Although this embodiment was illustrated and described in FIGS. 5-6 in terms of a single transition surface 146, no such limitation is to be implied and any or all interfaces 142, skirts 140, and edges 134 defined by the plenum body 132 may be so configured. In addition, a particular edge 134 may have a defined length of magnitude more or less than that of length L1. For example, one edge 134 may have a length L1 and another edge 134 may have a length L2, where L2 is a different length than L1. In all other respects the above description is applicable to such a configured fan shroud and one, some, or all of edges 134 with respective length L1, length, L2, etc., may include an interface 142 with an underside 144 having a transition surface 146 joining the edge 134 with a respective skirt 140 as herein described. For example, a second edge 134 with a length L1 (or length L2) may be joined to a second skirt 140 that extends proximate the second edge 134 with a second interface 142 preferably of length L1 (or length L2) having an underside 144 with a transition surface 146, a first segment 148 located on one side of the transition surface 146, and a second segment 150 located on the other side of the transition surface 146. The transition surface 146 of each such underside 144 has a length less than length L1 (or length L2) of the respective interface 142. The transition surface 146 of each underside can have a length as previously specified. Further, the transition surface 146 of each underside 144 can be in the form of any embodiment previously specified. FIG. 9A shows a configuration having transition surfaces 146 for all four skirts illustrated, three of which are depicted in phantom. As with the above description, the transition surface 146 can be positioned anywhere within the respective interface 142 but a center 149 of the transition surface 146 is preferably located at the midpoint of the respective interface 142, or, alternatively, substantially aligned with barrel midpoint 126.

The barrel 118 can be variously positioned with respect to the plenum body 132, as shown in FIG. 7. In a configuration such as shown in FIG. 7, the barrel midpoint 126 coincident with the axis of rotation need not be equidistant to the midpoint of each plenum edge 134. Moreover, the ratio between the barrel radius 124 and the distance of a line 170 proceeding from the barrel midpoint 126 perpendicular to the axis of rotation and to the outermost extent of skirt 140 as shown, for at least one plenum edge 134, can preferably range from approximately 0.70 to 0.88.

The following description utilizes additional reference numbers to express various geometric relationships within the cooling fan assembly previously described and as shown in FIGS. 5-7. Referring to FIGS. 8, 9A, 9B, and 9C, an axial cooling fan assembly includes a fan shroud 200 surrounding an axial fan 210. Fan 210 has one or more fan blades 212 coupled to a hub 214 rotating about an axis of rotation 216 for drawing air through a heat exchanger, not shown. A downstream direction along the axis of rotation 216 is defined such that the fan 210 is located downstream of the heat exchanger.

The fan shroud 200 includes a barrel 218 and a plenum 230. The barrel 218 generally encircles and contains the axial fan 210 and is concentric with the axis of rotation 216. The barrel 218 includes a housing portion 220 downstream of a base portion 222 that is coupled to the plenum 230. The housing portion 220 includes an inner surface 221. The barrel also defines a barrel radius 224 extending from a barrel midpoint 226 coincident with the axis of rotation to inner surface 221 of the housing portion 220.

The plenum 230 includes a plenum body 232 radially extending from the base portion 222 and having a substantially rectangular platform viewed from the upstream direction. The plenum body 232 can be angled from the base portion 222 such that at a further radius from the axis of rotation 216, the plenum body 232 is positioned further upstream. The plenum 230 also includes at least one skirt 240 coupled to the plenum body 232 and extending in a direction substantially parallel to the axis of rotation 216. The skirt 240 includes a substantially rectilinear upstream border 242 having a first end 236 and a second end 238.

A cross section C is defined parallel to the axis of rotation 216 and passes through barrel midpoint 226. Cross section C is also substantially normal to skirt 240 through which it passes. Cross section C is not otherwise limited to a particular orientation nor is it dependent upon the position of barrel 218 with respect to the plenum body 232. A distance D1 is defined between cross section C and first end 236 and a distance D2 is defined between cross section C and second end 238. A distance D3 is defined as the lesser value of D1 and D2, or if D1 equals D2, D3 is equal to either D1 or D2. A plane P1 is defined as parallel to and offset from cross section C. Preferably, plane P1 is offset a distance DP1 equal to between about 0.125 of barrel radius 224 and about 0.75 of barrel radius 224, but less than the value of D3. A plane P2 is defined as parallel to and offset from cross section C, on the opposite side of cross section C from plane P1. Preferably, plane P2 is offset a distance DP2 equal to between about 0.125 of barrel radius 224 and about 0.75 of barrel radius 224, but less than the value of D3. The sum of DP1 and DP2 is preferably within a range having a lower limit of about 0.25 of barrel radius 224 and an upper limit of about 1.5 of barrel radius 224. A plane P3 is defined as perpendicular to cross section C and contains a point that is on upstream border 242 of skirt 240. A plane P4 is perpendicular to plane P3 and perpendicular to cross section C and contains a point 250 on cross section C on the plenum body 232. Point 250 is preferably located a distance from the axis of rotation 216 at least a multiple of 1.1 of barrel radius 224. A plane P5 is defined as parallel to and offset from cross section C. Preferably, plane P5 is offset a distance equal to D3. A plane P6 is defined as parallel to and offset from cross section C on the opposite side of cross section C from plane P5. Preferably, plane P6 is offset a distance equal to D3.

Figure 10A:
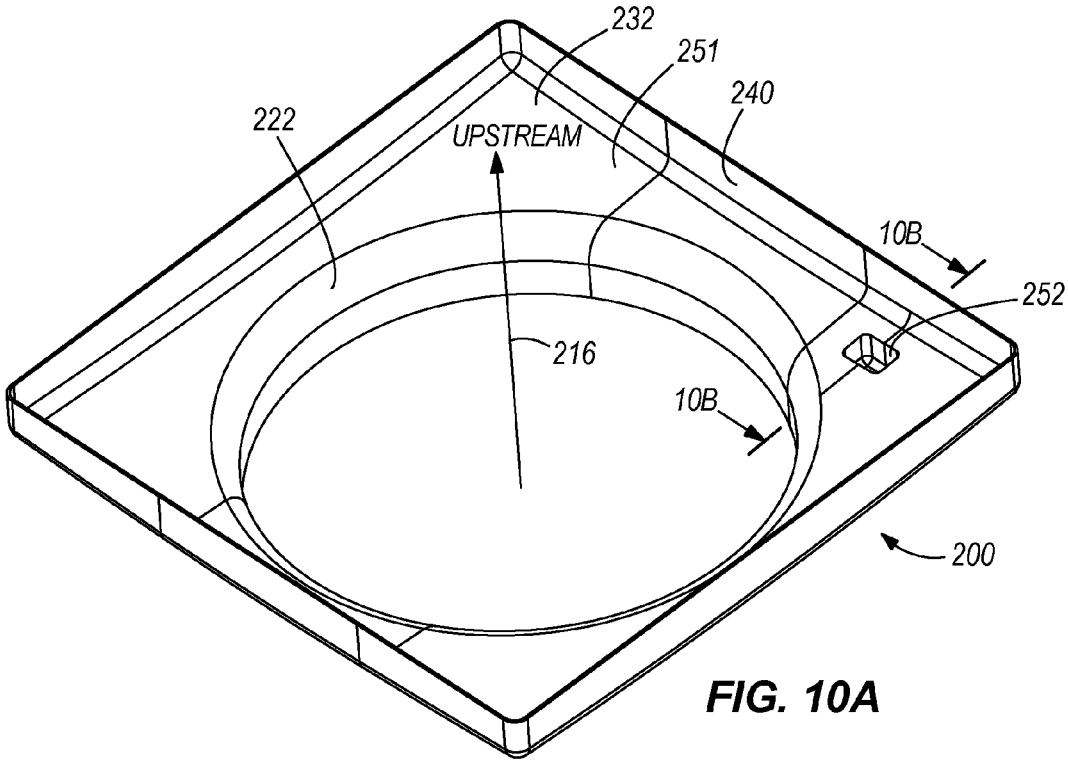
FIG. 10A is an upstream perspective view of a fan shroud showing a surface deviation.
Figure 10B:
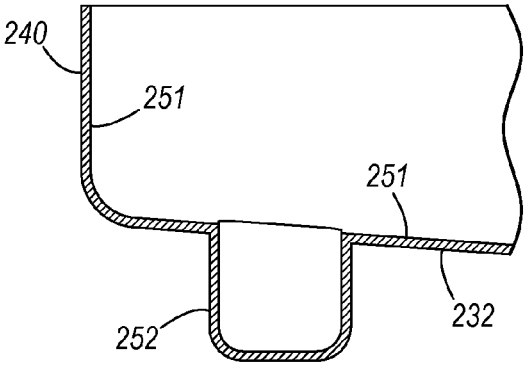
FIG. 10B is a partial cross sectional view of the fan shroud of FIG. 10A.
Figure 10C:
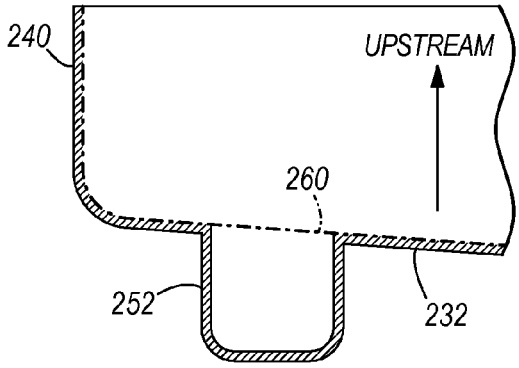
FIG. 10C is a partial cross sectional view of an effective surface area of the fan shroud of FIG. 10B.

Referring to FIGS. 10A and 10B, an upstream surface 251 is defined as the surface of the plenum 230 located on the upstream side of plenum body 232 and continuous with the surface of skirt 240 up to the upstream border 242. Generally, the upstream surface 251 monotonically increases in distance in a direction upstream from base portion 222. By monotonically increasing, the upstream surface 251 either increases or at least does not decrease in distance from base portion 222 in the upstream direction. Fan shroud 200, however, may include one or more surface deviations 252 departing from the monotonically increasing upstream surface 251. In FIG. 10C, an effective surface 260 is defined and shown as overlaid onto upstream surface 251. Referring to FIG. 10C, the effective surface 260 represents a surface equal to upstream surface 251 in the absence of a surface deviation 252, and equal to a monotonically increasing surface in the presence of a surface deviation 252. Therefore, effective surface 260 accounts for any surface deviations present in the fan shroud 200 in order to preserve a monotonically increasing reference surface.

With the aforementioned geometry, a volume V1 is defined as a volume enclosed by plane P1, plane P2, plane P3, plane P4, and effective surface 260. A volume V2 is defined as enclosed by plane P1, plane P3, plane P4, plane P5, and effective surface 260. A volume V3 is defined as enclosed by plane P2, plane P3, plane P4, plane P6, and effective surface 260. An average cross sectional area A1 is defined as volume V1 divided by the sum of offset distance DP1 and offset distance DP2, or V1/(DP1+DP2). An average cross sectional area A2 is defined as volume V2 plus volume V3 divided by the sum of distance D3 minus offset distance DP1 plus the distance D3 minus offset distance DP2, or (V2+V3)/((D3−DP1)+(D3−DP2)).

Figure 11:
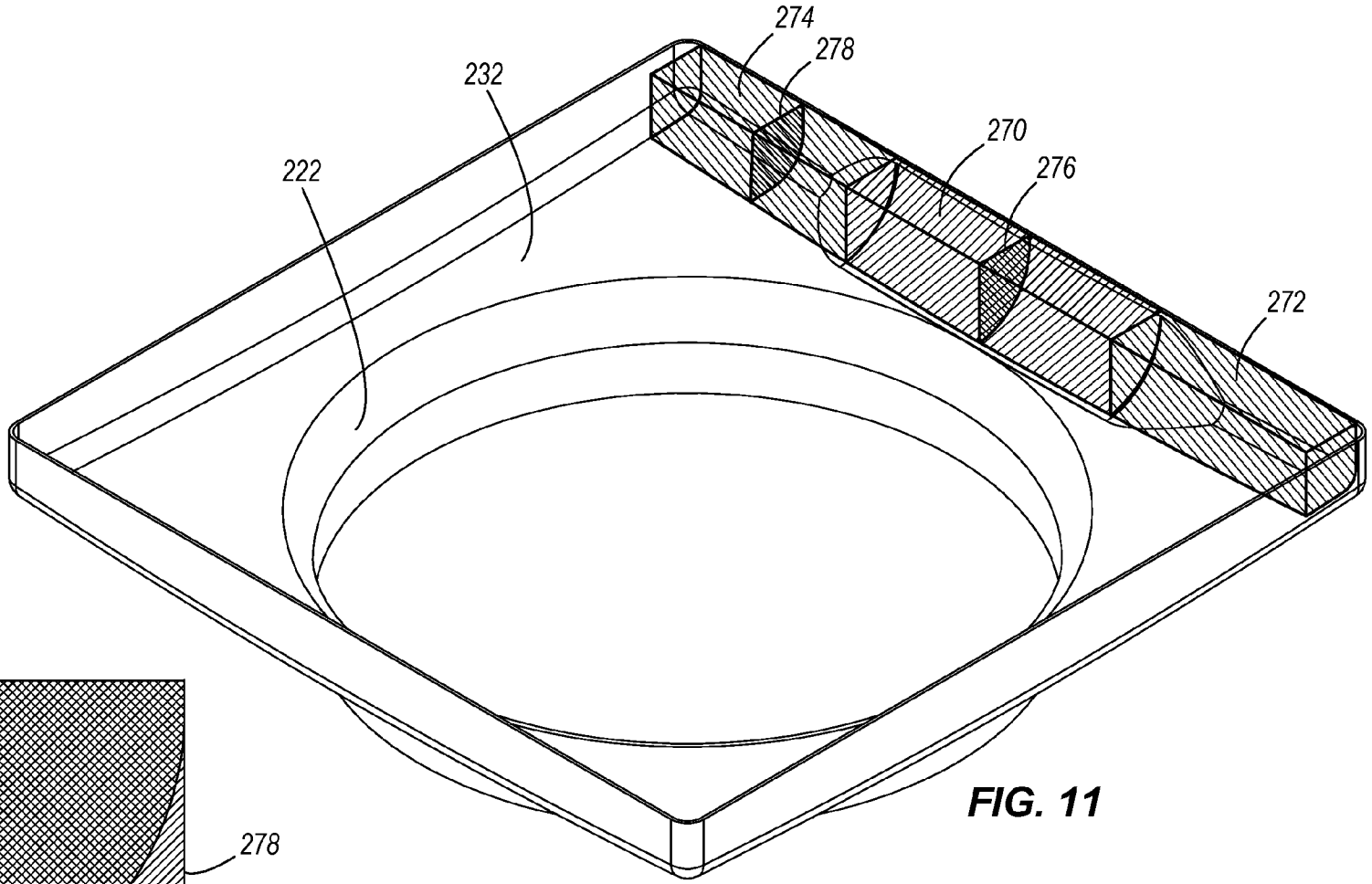
FIG. 11 is an upstream perspective view of the fan shroud of FIG. 8.
Figure 11A:
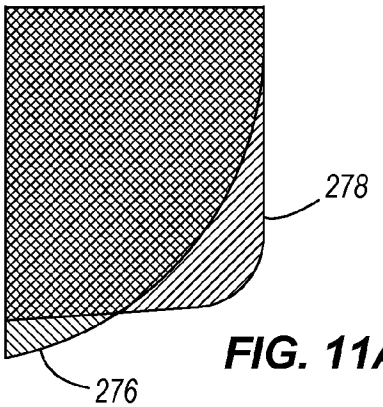
FIG. 11A is view of certain cross sectional areas of the fan shroud of FIGS. 8 and 11.
Figure 12:
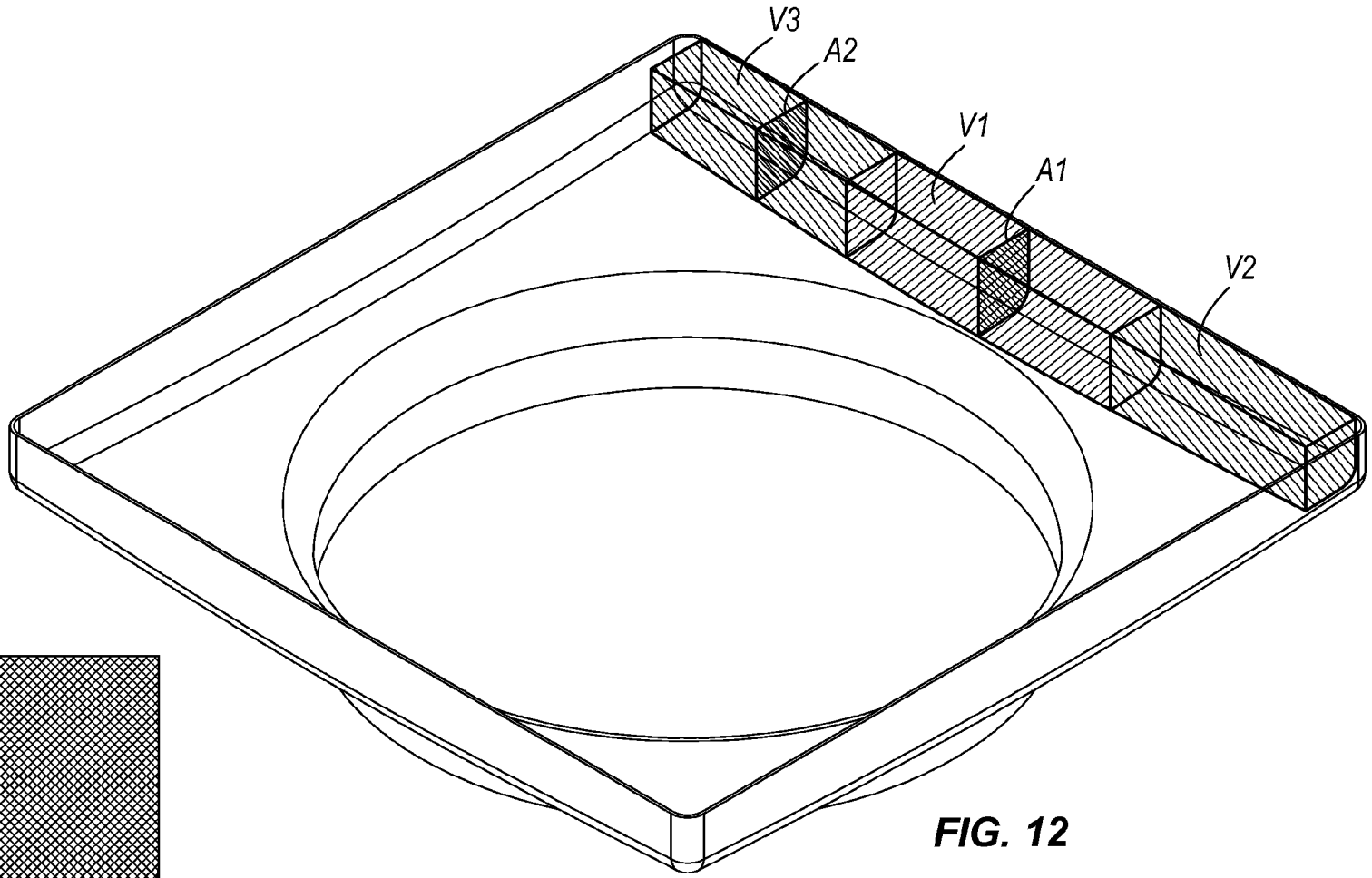
FIG. 12 is an upstream perspective view of the fan shroud of FIG. 1.
Figure 12A:
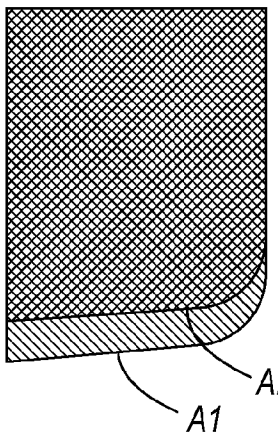
FIG. 12A is view of certain cross sectional areas of the fan shroud of FIG. 1.
Figure 13:
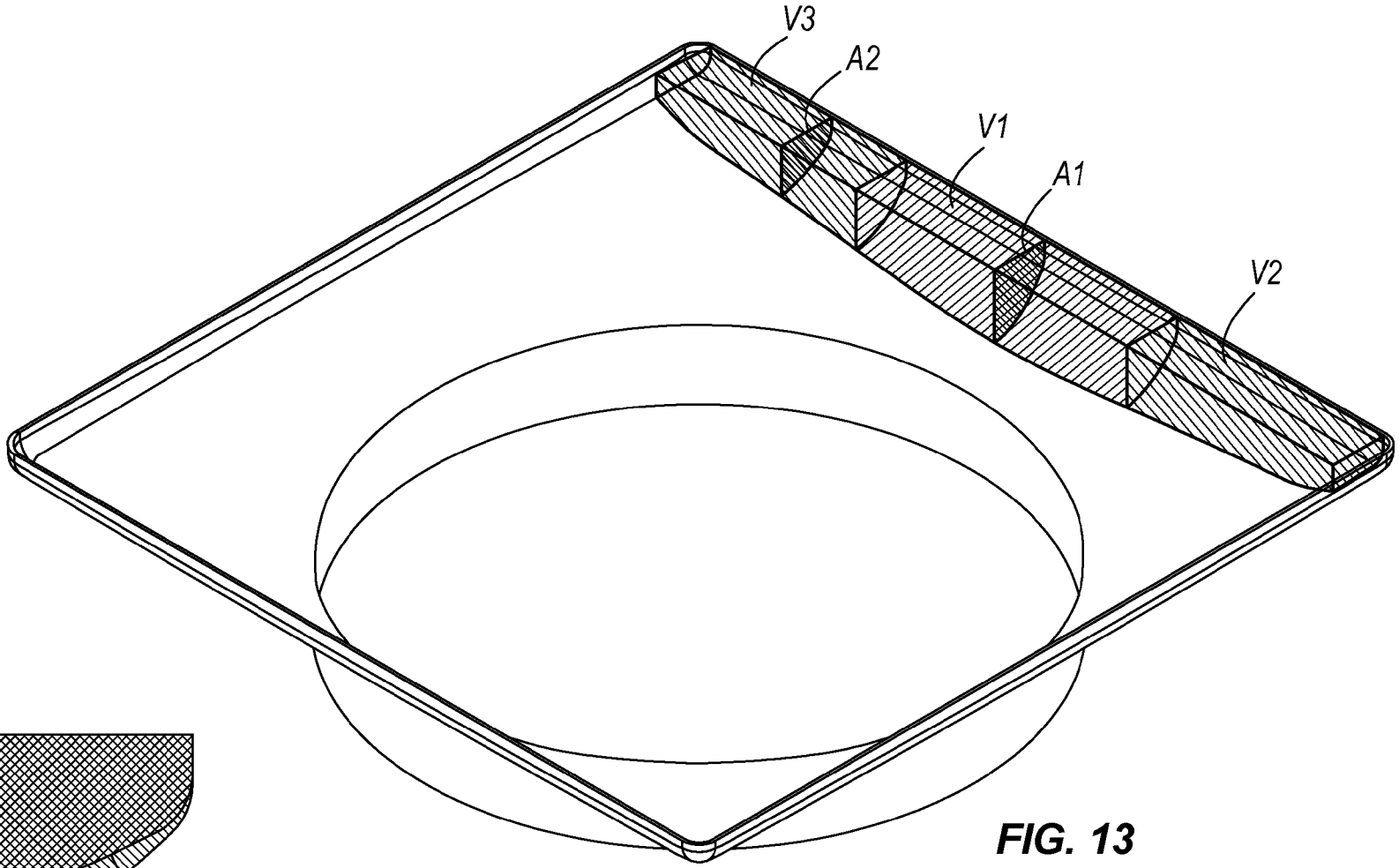
FIG. 13 is an upstream perspective view of the fan shroud of FIG. 3.
Figure 13A:
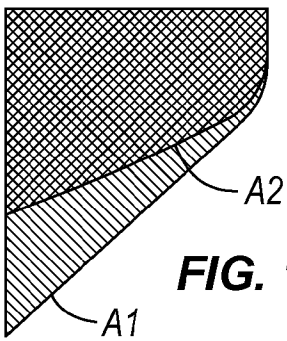
FIG. 13A is view of certain cross sectional areas of the fan shroud of FIG. 3.

As a result of the configuration of the axial cooling fan assembly, and in particular the fan shroud 200 as previously described, the average cross sectional area A1 will be less than the average cross sectional area A2. This is shown visually in FIGS. 11 and 11A, in which shaded volume 270, defined as previously described, represents volume V1, shaded volume 272 represents volume V2, and shaded volume 274 represents volume V3. The average cross sectional area calculated and depicted as area 276 is of a lesser value than the average cross sectional area calculated and depicted as area 278, as illustrated in FIG. 11A. The areas 276, 278, are representative of average areas and no significance should be placed on their precise position in FIG. 11. For comparison, FIGS. 12 and 12A show a corresponding illustration of such volumes and areas as described above for the conventional fan shroud of FIG. 1, and FIGS. 13 and 13B show a corresponding illustration of these volumes and areas for the conventional fan shroud of FIG. 3. FIGS. 12A and 13A in particular illustrate that area A1 is generally greater than area A2 for the conventional fan shrouds.

Though this embodiment was illustrated and described in FIGS. 8-11 in terms of a single cross section relative to a single skirt 240, no such limitation is to be implied. For example, separate cross sections, planes, and other parameters described above may be similarly defined and positioned with respect to one, some, or all of skirts 240 of a fan shroud 200, resulting in volumes and cross sectional areas as previously described for each skirt 240. Also as previously described and as illustrated in FIG. 7, the barrel 218 can be variously positioned with respect to the plenum body 232, in which case distance D1 is not equal to distance D2, which will be consequently reflected in the application of distance D3. In addition, the preceding description is applicable to embodiments beyond those disclosed in FIGS. 6A-6B.

Figure 14:
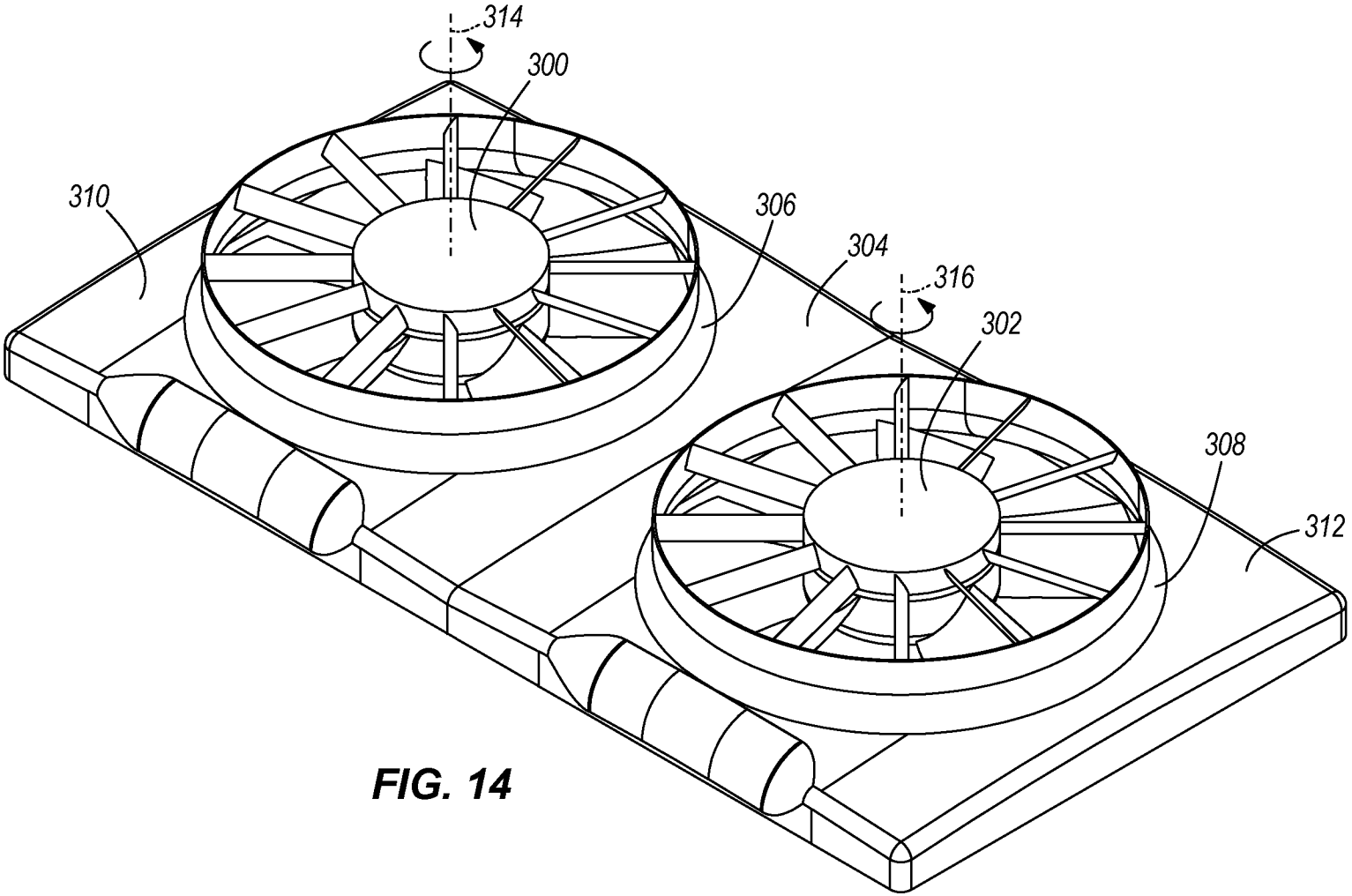
FIG. 14 is a perspective view of a fan assembly with multiple fans in accordance with the present invention.
Figure 14A:
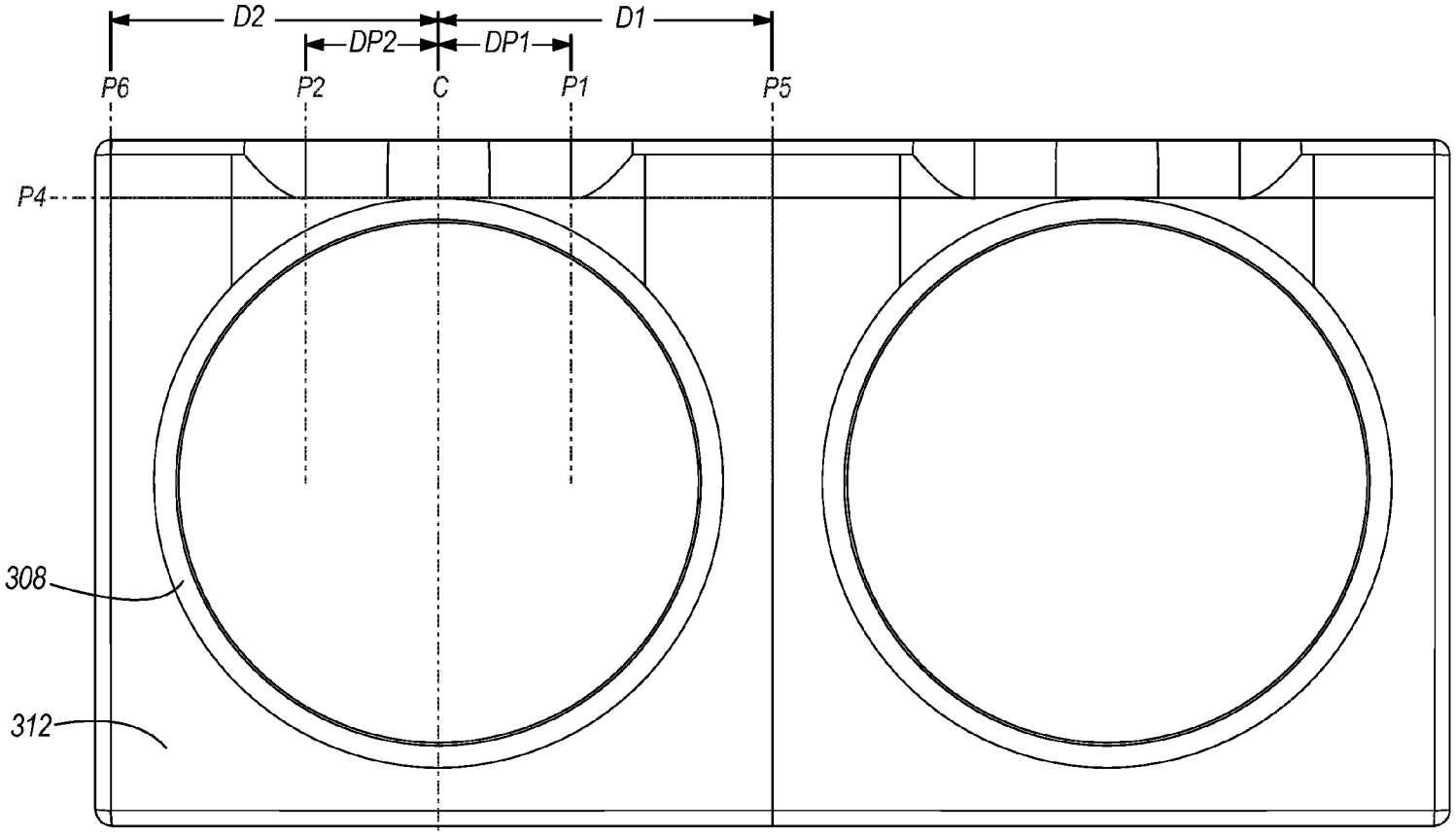
FIG. 14A is a plan view of the fan shroud of FIG. 14.
Figure 14B:
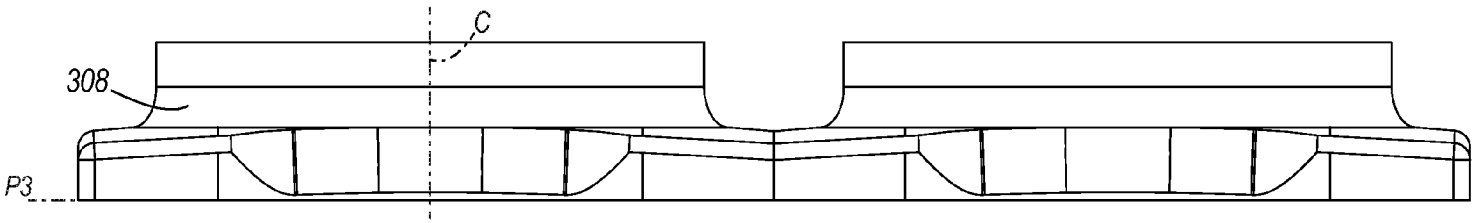
FIG. 14B is a side view of the fan shroud of FIG. 14A.

The above descriptions are equally applicable for axial cooling fan assemblies having multiple fans 300, 302, as shown in FIG. 14. In this configuration, a plenum body 304 transitions into two barrels 306, 308 and defines two fan shroud sections 310, 312. Barrels 306, 308 contain the fans 300, 302 and are concentric with axes of rotation 314, 316 about which fans 300, 302 rotate, respectively. In such a circumstance, each fan shroud section 310, 312 is analyzed separately as previously described. For example, FIGS. 14A and 14B show a plan view and side view, respectively, of a dual fan configuration with a cross section, planes, and other parameters similar to FIGS. 9A and 9B and as previously described. More than two fans and two fan shroud sections may also be contemplated and analyzed in this way.

Various features and advantages of the invention are set forth in the following claims.

The invention claimed is:

1. A fan shroud for a cooling fan assembly, the cooling fan assembly including a fan that is rotatable about an axis of rotation and that defines a downstream direction along the axis of rotation, the fan shroud comprising:

a barrel for containing the fan, the barrel concentric with the axis of rotation, and further including a base portion; and a plenum including:

a plenum body extending radially from the base portion, the plenum body defining at least one edge of length L1;

a skirt extending proximate the at least one edge of length L1 and substantially parallel to the axis of rotation; and an interface joining the at least one edge of length L1 and the skirt and having a length L1, wherein the interface comprises an underside having a transition surface of a length less than length L1, wherein the underside includes a first segment located on one side of the transition surface and a second segment located on the other side of the transition surface, and wherein the transition surface is in the form of a concavity, and further wherein a radius of the concavity is greater than a radius of both the first segment and the second segment.

2. The fan shroud of claim 1, wherein the barrel defines a barrel radius, and wherein the transition surface has a length between about 0.25 of the barrel radius and about 1.5 of the barrel radius.

3. The fan shroud of claim 1, wherein the barrel comprises a barrel midpoint coincident with the axis of rotation, and wherein a center of the transition surface is substantially aligned with the barrel midpoint.

4. The fan shroud of claim 1, wherein the plenum body defines a second edge of length L1.

5. The fan shroud of claim 4, wherein respective midpoints of the first edge of length L1 and of the second edge of length L1 are equidistant to the axis of rotation.

6. The fan shroud of claim 4, wherein a distance from the axis of rotation to a midpoint of the first edge of length L1 is not equal to a distance from the axis of rotation to a midpoint of the second edge of length L1.

7. The fan shroud of claim 4, further comprising:

a second skirt extending proximate the second edge of length L1 and substantially parallel to the axis of rotation;

a second interface joining the second edge of length L1 and the second skirt and having a length L1, wherein the second interface comprises a transition surface having a length less than length L1.

8. The fan shroud of claim 1, wherein the plenum body, the skirt, and the interface are of a substantially uniform thickness.

9. The fan shroud of claim 1, wherein the plenum body defines a second edge of length L2, wherein length L2 is not equal to length L1, and further comprising:

a second skirt extending proximate the second edge of length L2 and substantially parallel to the axis of rotation; and a second interface joining the second edge of length L2 and the second skirt and having a length L2, wherein the second interface comprises a transition surface having a length less than length L2.

10. The fan shroud of claim 1, wherein the cooling fan assembly includes a second barrel for containing a second fan rotatable about a second axis of rotation, the second barrel concentric with the second axis of rotation.

11. A cooling fan assembly for facilitating the transfer of heat through a heat exchanger, the cooling fan assembly comprising:

a fan rotatable about an axis of rotation and defining a downstream direction along the axis of rotation, wherein the fan is positioned downstream of the heat exchanger, the fan further including a plurality of fan blades; and a fan shroud including:

a barrel concentric with the axis of rotation and encircling the plurality of fan blades, the barrel defining a barrel radius and having a base portion; and a plenum including a plenum body and at least one skirt, the plenum body coupled to the barrel and having a substantially rectangular planform viewed in the upstream direction, the plenum body defining an effective surface monotonically increasing in upstream distance from the base portion, the at least one skirt extending substantially parallel to the axis of rotation and coupled to the plenum body, the at least one skirt including a substantially rectilinear upstream border having a first end and a second end, and wherein the plenum defines for the at least one skirt:

a cross section C through the axis of rotation and normal to the skirt;

a distance D1 between cross section C and the first end of the upstream border, and a distance D2 between cross section C and the second end of the upstream border;

a distance D3, wherein D3 is equal to the lesser of D1 and D2, or is equal to D1 if D1 equals D2;

a plane P1 parallel to and offset from cross section C an offset distance DP1 less than D3;

a plane P2 parallel to and offset from cross section C on the opposite side of cross section C from plane P1 an offset distance DP2 less than D3;

a plane P3 perpendicular to both cross section C and the axis of rotation and containing a point on the upstream border;

a plane P4 perpendicular to plane P3 and cross section C and containing a point located on cross section C and on the plenum body;

a plane P5 parallel to and offset from cross section C an offset distance equal to D3; and a plane P6 parallel to and offset from cross section C on the opposite side of cross section C from plane P5 an offset distance equal to D3, wherein a volume V1 is defined as enclosed by planes P1, P2, P3, P4 and the effective surface, a volume V2 is defined as enclosed by planes P1, P3, P4, P5 and the effective surface, a volume V3 is defined as enclosed by planes P2, P3, P4, P6 and the effective surface, an average cross sectional area A1 is defined as V1/(DP1+DP2), an average cross sectional area A2 is defined as (V2+V3)/((D3−DP1)+(D3−DP2), and wherein A1 is less than A2.

12. The cooling fan assembly of claim 11, wherein A1 is less than or equal to 0.95A2.

13. The cooling fan assembly of claim 11, wherein A1 is less than or equal to 0.90A2.

14. The cooling fan assembly of claim 11, wherein A1 is less than or equal to 0.80A2.

15. The cooling fan assembly of claim 11, wherein A1 is less than or equal to 0.70A2.

16. The cooling fan assembly of claim 11, wherein A1 is less than or equal to 0.50A2.

17. The cooling fan assembly of claim 11, wherein the offset distance DP1 is between about 0.125 and about 0.75 of the barrel radius.

18. The cooling fan assembly of claim 11, wherein the offset distance DP2 is between about 0.125 and about 0.75 of the barrel radius.

19. The cooling fan assembly of claim 11, wherein the point contained within plane P4 located on cross section C and on the plenum body is at least a multiple of 1.1 of the barrel radius from the axis of rotation.

20. The cooling fan assembly of claim 11, wherein the cooling fan assembly includes a second barrel for containing a second fan rotatable about a second axis of rotation, the second barrel concentric with the second axis of rotation.

21. The cooling fan assembly of claim 11, wherein D1 is not equal to D2.

* * * * *